US005648637A

United States Patent [19]

Clark, III

[11] Patent Number: 5,648,637

[45] Date of Patent: Jul. 15, 1997

[54] MULTI-DISK SHELL

[76] Inventor: George D. Clark, III, 700 Bowie Rd., Golden Valley, Ariz. 86413

[21] Appl. No.: 329,076

[22] Filed: Oct. 25, 1994

[51] Int. Cl.[6] ..... F42B 5/03; F42B 14/06

[52] U.S. Cl. ..... 102/438; 102/439; 102/491; 102/506; 102/522; 102/532

[58] Field of Search ..... 102/438, 439, 102/448, 449, 460, 491–497, 501, 502, 506, 517, 518, 522, 529, 532, 430, 451, 452, 453, 457, 520, 521, 523

[56] References Cited

U.S. PATENT DOCUMENTS

| | | | |
|---|---|---|---|
| 1,244,046 | 10/1917 | Ffrench | 102/494 |
| 1,303,727 | 5/1919 | Rice | 102/493 |
| 1,376,530 | 5/1921 | Greener | 102/438 |
| 2,798,431 | 7/1957 | Semon et al. | 102/495 |
| 3,862,600 | 1/1975 | Tocco | 102/438 |
| 3,951,040 | 4/1976 | Ziemba | 102/438 |
| 3,956,844 | 5/1976 | Misevich et al. | 102/503 |
| 4,173,930 | 11/1979 | Faires, Jr. | 102/448 |
| 4,434,718 | 3/1984 | Kopsch et al. | 102/522 |
| 4,656,947 | 4/1987 | Gordon et al. | 102/438 |
| 4,829,904 | 5/1989 | Sullivan | 102/439 |
| 4,850,278 | 7/1989 | Dinkha et al. | 102/501 |
| 4,942,818 | 7/1990 | Saxby | 102/444 |
| 4,947,755 | 8/1990 | Burczynski | 102/506 |
| 5,225,628 | 7/1993 | Heiny | 102/438 |
| 5,295,439 | 3/1994 | Carbone | 102/438 |

FOREIGN PATENT DOCUMENTS

| | | | |
|---|---|---|---|
| 103509 | 3/1984 | European Pat. Off. | 102/502 |
| 2303263 | 10/1976 | France | 102/438 |
| 1262830 | 3/1968 | Germany | 102/520 |
| 2011145 | 4/1994 | Russian Federation | 102/439 |

OTHER PUBLICATIONS

Webster's Seventh New Collegiate Dictionary, 1969, p. 821.

*Primary Examiner*—Harold J. Tudor
*Attorney, Agent, or Firm*—Halvorson & Venable, P.C.

[57] ABSTRACT

An otherwise conventional shell is provided with a load consisting of a plurality of axially stacked disks. The disks separate during flight and each strikes the target with a substantial portion of the initial momentum imparted to the disks thereby contributing to the stopping power of the load. In alternative embodiments, individual disks are scored so that on impact, the disks shatter into many smaller fragments, each capable of penetration into the target to impart additional wound trauma to the target. Disks may be made of lead, ceramic, or other dense material. Alternatively, plastic or a relatively soft elastomeric material is used when a non lethal but debilitating load is appropriate such as in crowd control situations.

1 Claim, 5 Drawing Sheets

Prior Art

MULTI-DISK SHELL

BACKGROUND OF THE INVENTION

1. Field of the Invention

The invention relates in general to firearms and, more particularly, ammunition, which, when fired, disperses into a multitude of projectiles.

In one embodiment, a more or less conventional shotgun shell, instead of having the conventional plurality of spherical pellets or shot contained therein, carries a plurality of stacked disks that can spread on firing to effect a greater stopping power on a target, i.e. each disk impacts on a larger area and, collectively, yield a greater total momentum on striking the target.

In alternative embodiments, the disks are frangible and, upon impact, shatter and inflict greater damage, including wound and trauma damage upon the target without adversely affecting the striking momentum. The use of either solid or frangible disks may indicated in anti-personnel applications.

2. Description of the Prior Art

A great variety of frangible shells have been designed that, when fired from a gun or cannon or dropped, as with a bomb in the form of a single shell, carries an explosive charge that explodes during flight, to fragment the shell into a multitude of individual components either during flight, or upon firing of a timed fuse, or, alternatively, explodes on impact with a target.

One such device is disclosed in the Drake patent, U.S. Pat. No. 109,600, wherein the interior of a projectile was scored in such manner such that when the enclosed charge was ignited, the single missile would break up into a multiple of parts flying in all directions described by the scoring, with few, if any, in the direction of travel or the forward target. In the Rice patent, U.S. Pat. No. 216,974, a single projectile bullet in axial segments had a separate head. On firing, the head separated and the axial segments were caused to fly apart in the air due to resistive air forces operating on a concave tip on the leading edge of the segments. The small axial segments flew in a conical format in the direction of travel of the main bullet to do additional damage to a target but had little or no "stopping" power.

The patent to Ffrench, U.S. Pat. No. 1,244,046, disclosed a projectile containing a plurality of stacked apertured metal disks that possessed a variety of slots to facilitate fragmentation thereof on impact. Such disks, however, were carried by a fired shell to a position above a target. After a predetermined interval had elapsed, a fuse in the shell detonated a charge, dispersing the disks rearward and downward to rain on personnel below.

The Sweeley patent, U.S. Pat. No. 2,343,818, discloses a conventional shot gun shell with a plurality of stacked cylinders contained therein which disperse on firing and yield a greater stopping effect on a target at a greater distance than conventional small pellets. However, due to the necessarily small number of such cylinders and the relatively small diameter of each cylinder, the stopping power is diminished because of the ease of penetration into the target and the slower release of energy.

U.S. Pat. No. 2,413,008, to Taglialatela, teaches a fragmentation bomb having a plurality of stacked annular "anvils" all inclined in the same direction to effect a concentrated umbrella fragmentation pattern upon explosion of the bomb. The disclosure of Sylwester, U.S. Pat. No. 3,720,168, showed a shaped charge missile warhead with a plurality of stacked elliptical disks inclined at a common angle with high explosive disposed between the disks. On detonation, the inclined disks and missile body effected a shaped charge in a single direction against, for example, ground troops.

In a later development of Henderson, in U.S.S.I.R. H1047, a fragmentation type bomb was designed with a war head using notched rods. On detonation, the bomb shell and the notched rods fragmented into a plurality of similar shaped and sized particles that flew in all directions but could not be directed in a specific direction.

In the prior art, there are described multiple component shells or missiles that separate after firing, as a result of an explosive charge carried by the missile. Most of these disclosures deal with fragmentation bombs and shells. Rice, however, teaches a separable bullet that separates, in part to cause additional damage to a target but with little attention paid to stopping power, a primary concern of the present invention.

Ffrench, on the other hand, discloses a bomb or missile with multiple frangible disks designed to separate in mid air on detonation only. This is primarily an anti-personnel weapon which is designed to fall on troops in trenches below, with no thought to stopping power.

The Sweeley shotgun shell provides fewer projectiles, but of larger size to provides a compromise between the stopping power of a single projectile and the wider impact area of a shotgun charge. Stopping power is an expressed concern of the present invention which seeks to provide such stopping power.

It has long been deemed desirable to have a device which could provide greater short range stopping power on a target by providing for the quick release of energy upon impact. The quicker the energy release, the greater the shock impact upon the target. It is well known that larger caliber weapons are capable of providing substantial "stopping power". However, because of the relative sizes of the single projectile and target, there is some concern with accuracy since a relatively small projectile must strike the target within a limited area of effectiveness.

Shotguns are used to deploy a large number of projectiles with a wider area of impact. However, each of the projectiles carries only a small part of the energy of the load and therefore, because of their large number and small size, lose energy during flight and cannot deliver the same impact to a target. Shotgun shells can be loaded with fewer projectiles of larger size. However, there yet remains a long standing need for a weapon with substantial stopping power over a wide area of impact to reduce the need for great accuracy in aiming.

SUMMARY OF THE INVENTION

The present invention is concerned with a weapon with the relaxed aiming requirements of a shotgun but with the stopping power of a large caliber pistol or rifle. According to the present invention, a relatively large bore weapon, such as a shotgun, flare pistol or other hand held weapons, is provided with a special cartridge that includes, as its pay load, a plurality of circular disks whose diameter is approximately equal to the bore of the weapon.

In an alternative embodiment, one or more disks of the stack are frangible and, upon impact with the target, can break into a plurality of smaller components, each capable of creating multiple wound channels. The disks will diverge slightly on firing from the gun and impact flatly against the target, thereby imparting a substantial impact momentum to the target. Because the disks quickly give up their force or momentum, the shock upon the target is substantial and, in the case of living targets, can incapacitate the target.

OBJECTS OF THE INVENTION

A primary object of the invention is to provide a projectile load which impacts a target with substantial momentum which is yielded quickly. This imparts a substantial stopping force upon the target.

Another object is to provide an ammunition load for hand held weapons that combines the stopping power of large caliber projectiles with the wide area of impact of a shotgun.

A further object of the invention is to provide a projectile load which includes a plurality of circular disks which spread during flight to impact on a target with substantial momentum which is yielded quickly.

Yet another object of the invention is to provide a cartridge with a plurality of circular disks at least one of which is frangible upon impact so that after substantially all of the kinetic energy is surrendered on contact, multiple wound channels are caused by further penetration of the individual pieces of the disk.

It is yet a still further object of the invention to provide a cartridge with improved stopping power by employing a plurality of frangible disks that quickly give up their momentum upon impact with the target and then break into many pieces, increasing the tissue tearing damage to the target.

Yet another object of the invention to provide a cartridge with a plurality of disks of flexible or elastomeric material to impart a non lethal but debilitating shock to the target. A still further object of the invention is to provide a wad with arms for containing the circular disks and guiding them through a barrel of a gun.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF A PREFERRED EMBODIMENT

Figure 1:
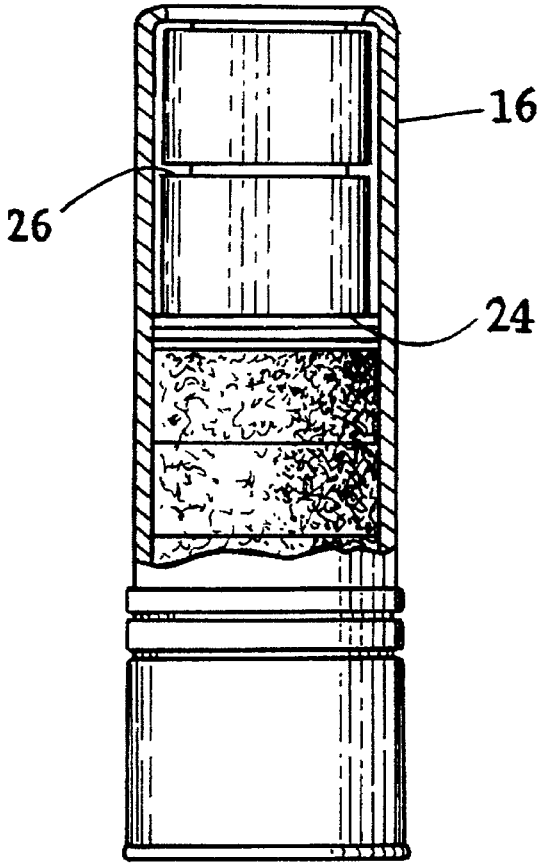
FIG. 1 is a view, partly in cross section and partly in elevation of the prior art shot gun shell of Sweeley.

The prior art shot gun shell taught by Sweeley is shown in cross section in FIG. 1 as a typical example of the prior art of multiple projectile cartridges. As shown, a shotgun shell 12 is comprised of a metallic base 14 having an upper cylindrical shell 16 constructed of a heavy paper or other suitable material.

A powder charge 18 is placed in the base 14 and extends upwardly to fill the lower portion of the cylindrical shell 16. One or more disks 20 constitute the packing or wadding and are inserted within the cylindrical shell 16. These disks 20 have a diameter that is substantially equal to the inner diameter of the shell 16 and are positioned to overlie the powder charge 18. The disks 20 are usually destroyed with ignition of the powder charge 18.

Figure 2:
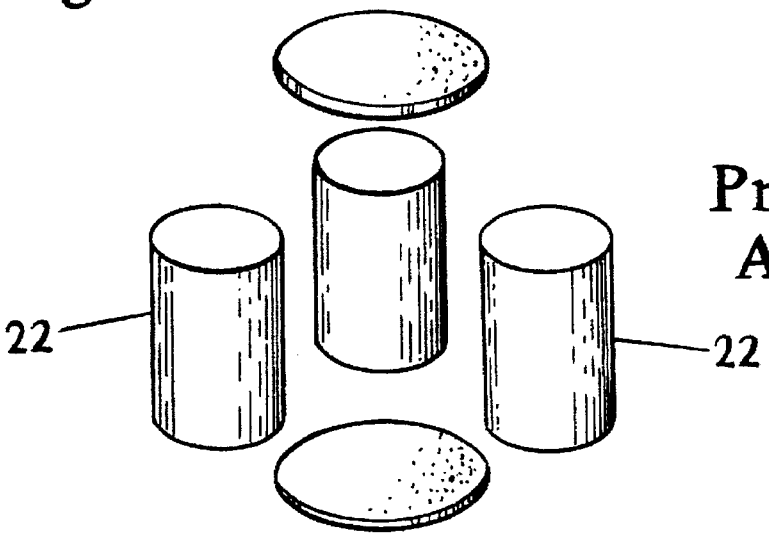
Prior Art Fig. 2
FIG. 2 is a disassembled perspective view of one tier of a multi-missile load for the shotgun shell of FIG. 1.

A tier of substantially cylindrical metallic missiles or slugs 22 are arranged in a group and inserted within the cylindrical shell 16. As seen in FIG. 2, each tier comprises three, substantially identical cylindrical slugs 22 having the same diameters and lengths. Each of the slugs 22 is provided with flattened end portions 24, 26 which lie in spaced parallel planes that are perpendicular to the longitudinal axes of the slugs 22.

Each of the slugs 22, when assembled in the manner shown in FIG. 2, has a line of tangency on the external surface thereof with each of the other two slugs 22. In so grouping the slugs 22, a centrally located interstice 28 is formed. As shown in FIG. 2, this interstice 28 is sealed at the top or leading surface 26 of each of the slugs 22 by means of an impermeable disk 30 which is provided with an adherent on the underside thereof.

As shown in FIG. 1, a first tier of slugs 22 is inserted within the paper shell 16 so that the base surfaces 24 rest on the packing 20. A second tier of slugs 22, assembled in the manner described, is then inserted within the cylindrical paper shell 16 and capped with a second disk 30. The bases 24 of the second tier of slugs 22 rest on the disk 30 affixed to the top of the lower tier. A second adhesive disk 30' is adhered to the upper tier of slugs 22 so that both tiers are held together in their relative positions blocking the central, interstitial passage 28. The paper shell 16 is then crimped over the upper disk 30 on the second tier to hold the component elements of the shell 12 in their respective positions.

Figure 3:
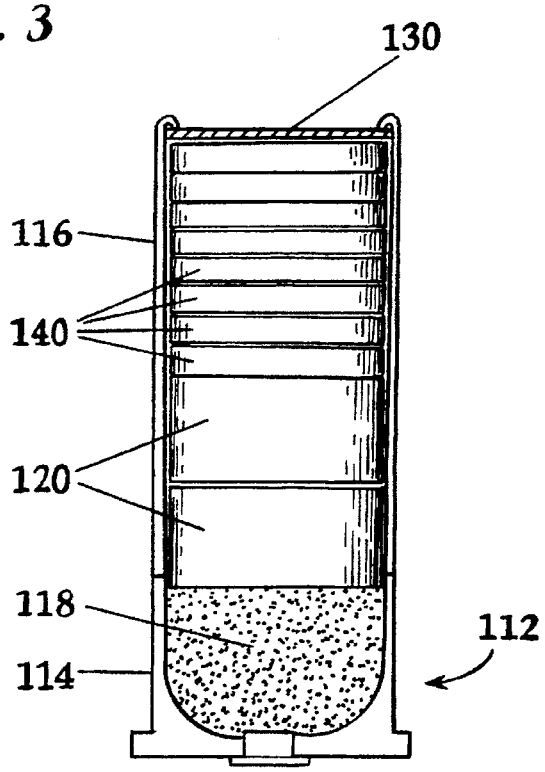
FIG. 3 is a side section view of a multi-disk shotgun shell according to the present invention.

A cross section of a first embodiment of the invention is shown in FIG. 3, illustrated herein as a cartridge in the form of a shot gun shell 112, superficially similar to the prior art shot gun shell 12. Technology has provided newer and different materials for the cartridge shell 112 and are utilized in the present invention.

Further, the prior art cartridge of FIGS. 1 and 2 show the payload to be cylindrical slugs 22 in the shell 12. The diameter of each slug 22 is less than the diameter of the interior of the shell 16, necessitating the use of the disks 30, 30' in a manner similar to a piston to propel the slugs 22 toward the target.

As taught by Sweeley, each of the slugs 22 contributes to the impact force and each follows a similar path to the target although aerodynamic forces will cause some divergence from each other. The relatively small diameter of each of the slugs 22, however means that energy will not be dissipated upon impact, but that the slug will penetrate the target relatively easily where the energy is slowly absorbed over the wound path.

Figure 4:
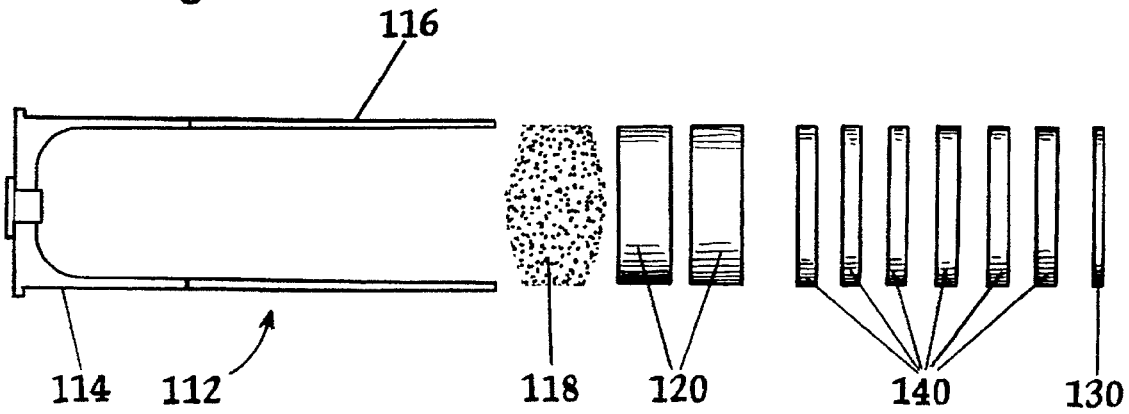
FIG. 4 is an exploded side view of the shell of FIG. 3.

The embodiment illustrated in section in FIG. 3 and in an exploded view in FIG. 4, shows a shell 112 which may be made of a plastic material. The base 114 of the shell has an aperture to receive a primer charge. With the use of some plastics, it may be necessary to provide a metallic reinforcement in the base 114. A powder charge 118 is placed in the base and secured with a wadding 120.

A plurality of stacked, circular disks 140, are confined within the cylindrical body portion 116 of the shell 112 between the packing or wadding disks 120 the open end of the shell 112. The circular disks 140 of the present invention each have a diameter that is approximately equal to the interior diameter of the cylindrical body portion 116. A sealing disk 130, preferably of plastic, is fitted over the stack of disks 140 and the cylindrical body portion 116 is crimped to secure the disks 140 in place.

When the cartridge 112 is fired, the propellant force of the exploding charge 116 is directed at the stack of circular disks 140, with little or no loss of force resulting through leakage around or through the payload. Through the flight path, the circular disks 140 will diverge approaching the target, providing a reasonably large area of impact within which the momentum of the several disks 140 can cumulatively provide a relatively greater degree of "stopping power" with substantial target upset and disruption.

Figure 5:
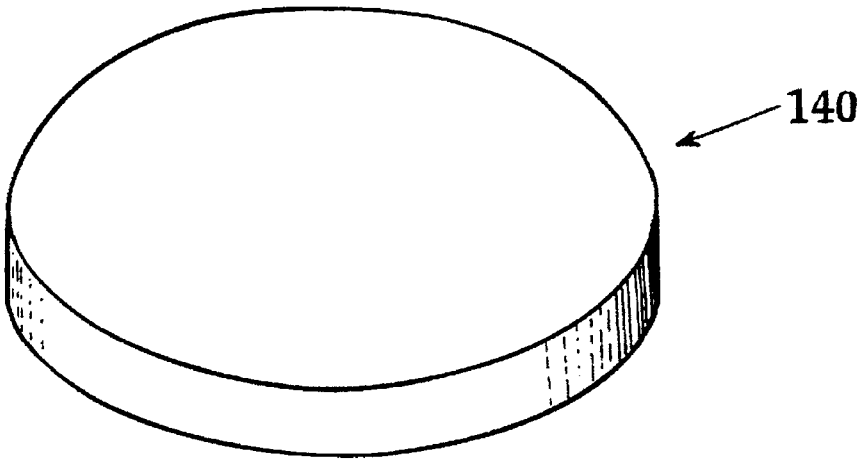
FIG. 5 is a perspective view of a first embodiment of a disk useful in the present invention.
Figure 6:
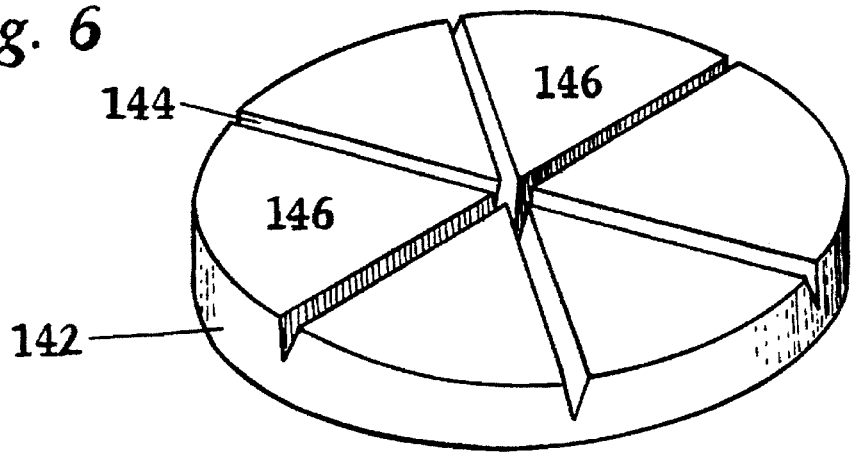
FIG. 6 is a perspective view of an alternative embodiment of a disk of the present invention with scoring on one surface.
Figure 7:
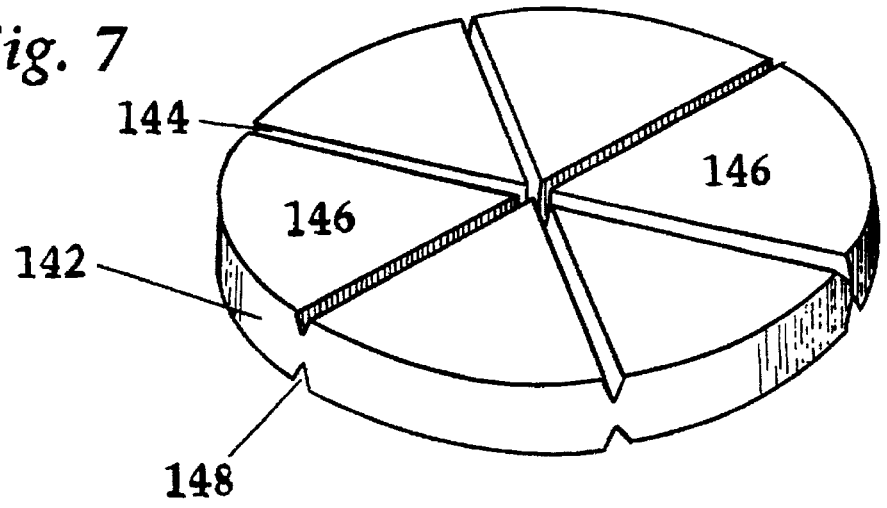
FIG. 7 is a perspective view of a second alternative embodiment of a disk of the present invention with scoring on both upper and lower surfaces.

FIG. 5, 6 and 7 are perspective views of different embodiments of disks 140 according to the present invention. In FIG. 5 there is shown a solid flat disk 140 which, upon impact, rapidly loses its energy to deliver maximum stopping power.

The embodiment shown in FIG. 6 is an individual disk 142 with deep radial scores or grooves 144 across one face of the disk 142 to assure fracture and breakup on impact. When the disk 142 fractures, the individual segments 146, each of which still possesses substantial momentum, tends to penetrate the target causing multiple wound channels which can further incapacitate the target, in addition to the initial impact effects.

FIG. 7 shows an alternate embodiment 142' with radial scores or grooves 144 on top and matching grooves 148 on bottom of each disk 142' to further weaken the disk structure to increase likelihood of fracture into a multiplicity of particles 146' on impact. Disks are preferably made of a relatively heavy dense metal such as lead, but may equally well be composed of ceramics, plastics or even rubbers or other elastomeric substances, depending upon the requirements of the situation. Clearly, such relatively soft alternative materials are preferable in crowd control situations.

The size of the disks is primarily dictated by the inside diameter of the shell in which they are placed and the minimum bore of any choke device that might be installed in the weapon. The thickness of the projectile disks of the present invention, which, in the preferred embodiment is less than one eighth inch, can vary, depending upon the number of disks to be used as a load and the desired size of the resulting particles. Groove depth may vary, but, in the preferred embodiment is sufficient to provide a parting line whose thickness ranges from 0.010" to 0.020" inches.

Figure 10:
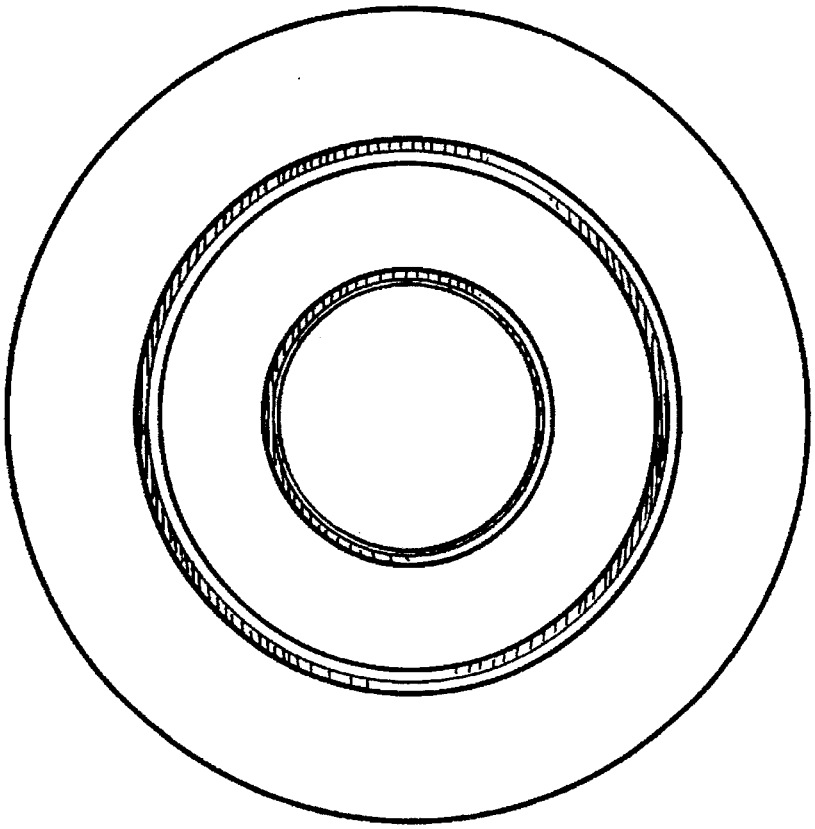
FIG. 10 is a view of a concentrically scored disk of the present invention.
Figure 11:
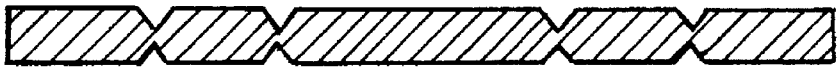

It is also within the scope of the invention to provide the missile disks with concentric scoring or yet other geometrical scoring designs, as illustrated in FIGS. 10 and 11. These designs vary the degree of fracture and the size and shape of the particles resulting from the fractured disk. For example, a combination of radial and concentric grooves will result in particles with a wide variety of sizes and shapes, some of which will have a greater penetrating ability than others.

Figure 8:
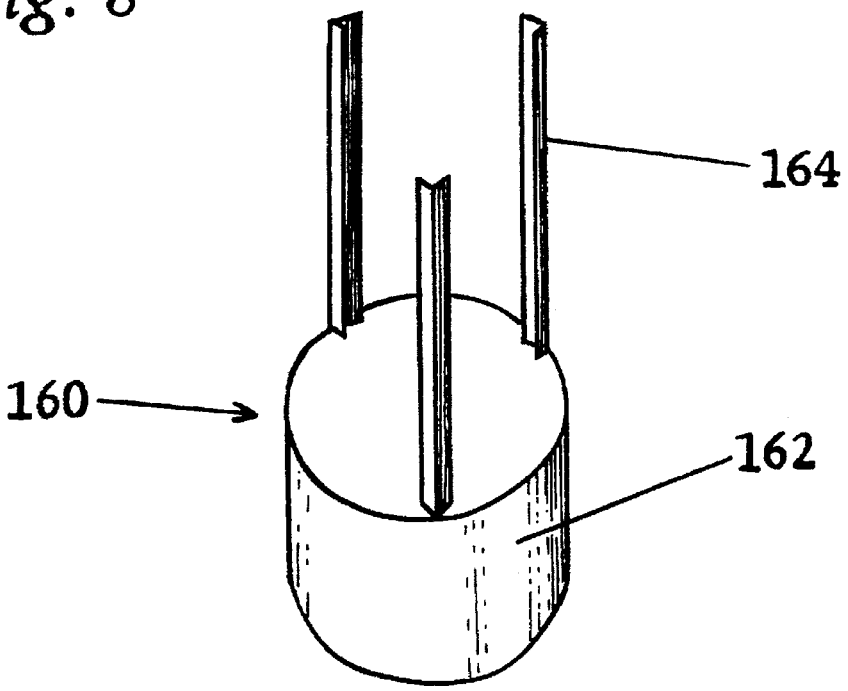
FIG. 8 is a perspective view of a combination wad and disk centering device.
Figure 9:
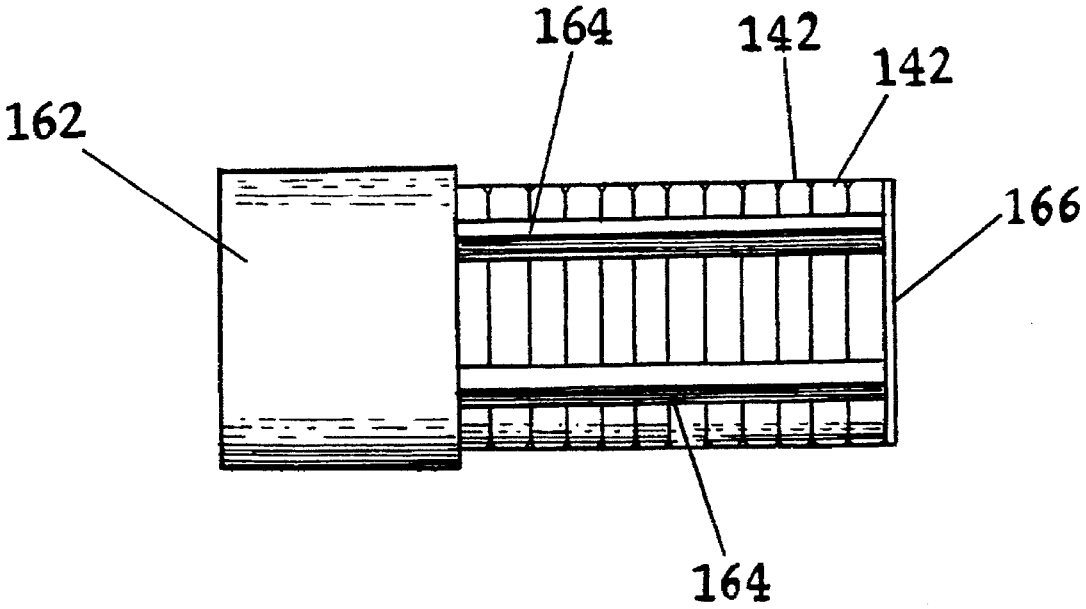
FIG. 9 is a side view of the wad and centering device of FIG. 8 with a plurality of disks according to the present invention.

Turning next to FIGS. 8 and 9 there is shown an assembly 160 which includes a wadding 162 and integral arms 164 which are adapted to receive the disks 140 (or the variations thereof as shown in FIGS. 5, 6 and 7). The dimensions of the arms 164 are determined by the relative diameters of the disks and the bore of the weapon in which the shell is to be used.

FIG. 9 is a side view of the assembly 160 in which is placed a plurality of disks 142. The assembly consists of a base and at least three integral V-shaped arms. A vertex formed by the intersection of two extention arms. The vertex is in slideable contact with an interior diameter of a gun barrel, and the extention arms are in contact with the circular disks. The arms 164 will center the disks 142 in the cartridge of FIG. 3. The assembly is held intact by an upper disk 166 which maintains the disks 142 as an integral group within the cartridge and during the initial phases of pyrotechnic discharge and deployment through the barrel of the weapon.

The relative light weight of the assembly 160 makes it unlikely that the assembly will survive intact when the cartridge is ignited. If the weapon is equipped with a choke apparatus, then the assembly 160 will be intercepted by the choke assembly and destroyed in the process.

It should be understood that the foregoing specific components illustrated and described in the specification are not to be interpreted as limiting the scope of the invention. The breadth and depth of the overall inventive concept is deemed to be limited only by the following appended claims.

What is claimed as new is:

1. A shell comprising:

a. a casing having a proximal end, a proximal section, a distal section, a distal end, and an inner diameter;

b. gunpowder contained in the proximal section of said casing;

c. a base attached to the proximal end of said casing and including a primer for percussive ignition of said gunpowder;

d. a plurality of disks that are axially aligned and contained in the distal section of said casing; and e. a wad comprising 1. a cylindrical base interposed between said powder and said plurality of disks; and 2. at least three arms attached to a top side of the base of said wad, each arm extending between said casing and said plurality of disks and reaching to the distal end of said casing, wherein the at least three arms are V-shaped, and having a vertex of the V-shape in slideable connection to said casing and two extension arms of the V-shape in contact with said plurality of disks.

* * * * *